US011710912B2

(12) United States Patent
Takeuchi et al.

(10) Patent No.: US 11,710,912 B2
(45) Date of Patent: Jul. 25, 2023

(54) TERMINAL AND WIRE WITH TERMINAL

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Shunya Takeuchi, Mie (JP); Masaaki Tabata, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 114 days.

(21) Appl. No.: 17/598,527

(22) PCT Filed: Mar. 23, 2020

(86) PCT No.: PCT/JP2020/012606
§ 371 (c)(1),
(2) Date: Sep. 27, 2021

(87) PCT Pub. No.: WO2020/203391
PCT Pub. Date: Oct. 8, 2020

(65) Prior Publication Data

US 2022/0181796 A1 Jun. 9, 2022

(30) Foreign Application Priority Data

Mar. 29, 2019 (JP) ..... 2019-065858

(51) Int. Cl.
*H01R 4/50* (2006.01)
*H01R 4/20* (2006.01)
*H01R 4/18* (2006.01)

(52) U.S. Cl.
CPC ..... *H01R 4/203* (2013.01); *H01R 4/183* (2013.01); *H01R 4/5075* (2013.01)

(58) Field of Classification Search
None
See application file for complete search history.

(56) References Cited

U.S. PATENT DOCUMENTS

| | | | |
|---|---|---|---|
| 4,413,872 | A | 11/1983 | Rudy, Jr. et al. |
| 6,749,456 | B1 | 6/2004 | Conner et al. |
| 7,306,495 | B2 | 12/2007 | Hashimoto et al. |

FOREIGN PATENT DOCUMENTS

| | | | |
|---|---|---|---|
| JP | 532-005148 | Y1 | 6/1957 |
| JP | H05-023422 | U | 3/1993 |
| JP | 2005-129447 | A | 5/2005 |

OTHER PUBLICATIONS

International Search Report dated Apr. 28, 2020 for WO 2020/203391 A1 (4 pages).

*Primary Examiner* — Ross N Gushi
(74) *Attorney, Agent, or Firm* — Venjuris, P.C.

(57) ABSTRACT

A terminal of the present disclosure is the terminal to be connected to a wire including a core and includes a terminal body and a sliding portion. The terminal body includes a sandwiching portion. The sliding portion is slidable in a front-rear direction between a partial locking position and a full locking position. The sliding portion includes a pressurizing portion configured to press the sandwiching portion at the full locking position to sandwich the core in a first direction by the sandwiching portion, at least a pair of first contact portions configured to contact the core in the first direction when the core is inserted into the sliding portion, (Continued)

and at least a pair of second contact portions configured to contact the core in a second direction intersecting the first direction when the core is inserted into the sliding portion.

6 Claims, 12 Drawing Sheets

TERMINAL AND WIRE WITH TERMINAL

CROSS REFERENCE TO RELATED APPLICATIONS

This application is a national phase of PCT application No. PCT/JP2020/012606, filed on 23 Mar. 2020, which claims priority from Japanese patent application No. 2019-065858, filed on 29 Mar. 2019, all of which are incorporated herein by reference.

TECHNICAL FIELD

The present disclosure relates to a terminal and a wire with terminal.

BACKGROUND

Conventionally, a wire with terminal in which a terminal is connected to a core exposed from an end of a wire has been known. Some of such terminals include, for example, a crimping portion to be crimped to the core exposed form the end of the wire from outside.

The above terminal is crimped to the wire, for example, as follows. First, the terminal having a predetermined shape is formed by press-working a metal plate material. Subsequently, the terminal is placed on a placing portion of a lower die located on a lower side, out of a pair of dies relatively movable in a vertical direction. Subsequently, the core exposed from the end of the wire is placed on the crimping portion of the terminal. Then, one or both of the pair of dies are moved in direction(s) toward each other and the crimping portion is sandwiched between a crimper of the upper die and the placing portion of the lower die, whereby the crimping portion is crimped to the core of the wire. In the above way, the terminal is connected to the end of the wire (see Patent Document 1).

PRIOR ART DOCUMENT

Patent Document

Patent Document 1: JP 2005-050736 A

SUMMARY OF THE INVENTION

Problems to be Solved

If the core is connected by being sandwiched instead of being crimped by the above crimping portion, the terminal may be possibly composed of two components including a terminal body and a sliding portion disposed behind the terminal body. In this case, the core is first inserted into the sliding portion, wherefore a structure facilitating the insertion of the core into the sliding portion is desired.

Means to Solve the Problem

A terminal of the present disclosure is a terminal to be connected to a wire including a core, the terminal including a terminal body and a sliding portion, wherein the terminal body includes a sandwiching portion configured to sandwich the core of the wire, the sliding portion is slidable in a front-rear direction between a partial locking position and a full locking position while being externally fit to a region where the sandwiching portion is provided, and the core is inserted into the sliding portion from behind, and the sliding portion includes a pressurizing portion configured to press the sandwiching portion at the full locking position to sandwich the core in a first direction by the sandwiching portion, at least a pair of first contact portions provided behind the pressurizing portion and configured to contact the core in the first direction when the core is inserted into the sliding portion, and at least a pair of second contact portions provided behind the pressurizing portion and configured to contact the core in a second direction intersecting the first direction when the core is inserted into the sliding portion.

Effect of the Invention

According to the present disclosure, a core inserting operation can be facilitated.

DETAILED DESCRIPTION TO EXECUTE THE INVENTION

Description of Embodiments of Present Disclosure

Figure 1:
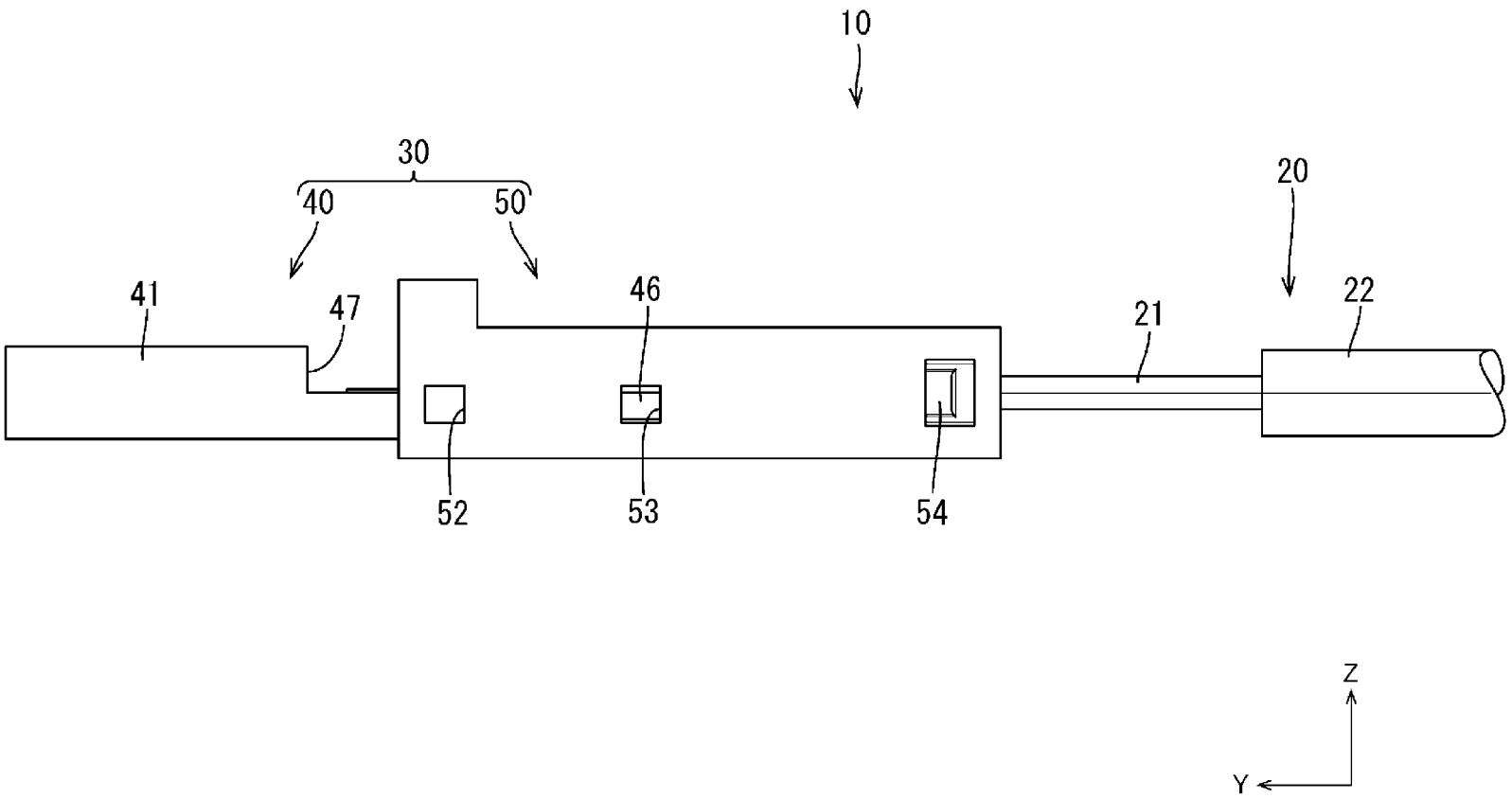
FIG. 1 is a side view of a wire with terminal in a first embodiment.

First, embodiments of the present disclosure are listed and described.

(1) The terminal of the present disclosure is a terminal to be connected to a wire including a core and includes a terminal body and a sliding portion, wherein the terminal body includes a sandwiching portion configured to sandwich the core of the wire, the sliding portion is slidable in a front-rear direction between a partial locking position and a full locking position while being externally fit to a region where the sandwiching portion is provided, and the core is inserted into the sliding portion from behind, and the sliding portion includes a pressurizing portion configured to press the sandwiching portion at the full locking position to sandwich the core in a first direction by the sandwiching portion, at least a pair of first contact portions provided behind the pressurizing portion and configured to contact the core in the first direction when the core is inserted into the sliding portion, and at least a pair of second contact portions provided behind the pressurizing portion and configured to contact the core in a second direction intersecting the first direction when the core is inserted into the sliding portion.

When the core of the wire is inserted into the sliding portion from behind, a movement in the first direction is restricted by the contact of the core with at least the pair of first contact portions and a movement in the second direction is restricted by the contact of the core with at least the pair of second contact portions, wherefore the core is inserted straight. Even if the core is curled, the core is also inserted straight since the core is straightened by the respective contact portions and inserted.

When the core is inserted straight into the sliding portion and enters the terminal body with the sliding portion held at the partial locking position, the core is disposed along the sandwiching portion. When the sliding portion is slid from the partial locking position to the full locking position in this state, the sandwiching portion is pressed in the first direction by the pressurizing portion and the core is sandwiched in the first direction by the sandwiching portion. In this way, the wire and the terminal are electrically connected.

(2) Preferably, an inserting portion into which the core is inserted is shaped to include the second contact portion and a pair of the first contact portions projecting further toward the core than the second contact portion from both sides of the second contact portion.

When the core is inserted into the inserting portion, movements in the first direction and second direction are restricted by the contact of the core with the inserting portion.

(3) Preferably, the inserting portion is formed into an arched shape by the second contact portion and the pair of first contact portions connected to the second contact portion and a pair of the inserting portions are disposed on both sides of the core.

The arched shape may be a curved surface shape other than an arcuate shape.

When the core is inserted between the pair of inserting portions, movements in the first direction and second direction are restricted by the contact of the core with the arched inserting portions.

(4) Preferably, the sliding portion includes a pair of guiding portions enlarged in diameter from rear edges of the pair of inserting portions toward a rear side.

The core is guided into between the pair of inserting portions by contacting the pair of guiding portions.

(5) Preferably, the pair of the first contact portions are provided to project in the first direction from a pair of walls facing each other in the first direction, out of a peripheral wall of the sliding portion, and the pair of second contact portions are provided to project in the second direction from a pair of walls facing each other in the second direction, out of the peripheral wall of the sliding portion.

When the core is inserted between the pair of first contact portions, a movement in the first direction is restricted by the contact of the core with the tips of the first contact portions. When the core is inserted between the pair of second contact portions, a movement in the second direction is restricted by the contact of the core with the tips of the second contact portions.

(6) A wire with terminal of the present disclosure is a wire with terminal including the above terminal and the above wire.

Details of Embodiments of Present Disclosure

A specific example of a wire with terminal 10 of the present disclosure is described below with reference to the drawings. Note that the present invention is not limited to these illustrations and is intended to be represented by claims and include all changes in the scope of claims and in the meaning and scope of equivalents.

First Embodiment

A first embodiment of the present disclosure is described with reference to FIGS. 1 to 6. In the following description, a vertical direction (first direction) is based on a vertical direction shown in FIG. 1, wherein a direction indicated by an arrow Z is an upward direction. A front-rear direction is based on a lateral direction shown in FIG. 1, wherein a direction indicated by an arrow Y is a forward direction. A lateral direction (second direction) is based on a vertical direction shown in FIG. 2, wherein a direction indicated by an arrow X is a leftward direction.

Wire 20

As shown in FIG. 1, a wire 20 is disposed to extend in the front-rear direction. The wire 20 includes a core 21 and an insulation coating 22 surrounding the outer periphery of the core 21. The insulation coating 22 is made of insulating synthetic resin. The core 21 of this embodiment is a single core made of one metal wire, but may be a stranded wire formed by twisting a plurality of metal thin wires. The core 21 of this embodiment is made of copper or copper alloy, but an arbitrary metal such as copper, copper alloy, aluminum or aluminum alloy can be appropriately selected as a metal constituting the core 21 if necessary.

Terminal 30

A terminal 30 includes a terminal body 40 made of metal and a sliding portion 50 slidable with respect to the terminal body 40.

Terminal Body 40

The terminal body 40 is formed into a predetermined shape by a known method such as press-working, cutting or casting. An arbitrary metal such as copper, copper alloy, aluminum, aluminum alloy or stainless steel can be appropriately selected as a metal constituting the terminal body 40 if necessary. The terminal body 40 according to this embodiment is made of copper or copper alloy. A plating layer may be formed on the surface of the terminal body 40. An arbitrary metal such as tin, nickel or silver can be appropriately selected as a metal constituting the plating layer if necessary. Tin plating is applied to the terminal body 40 according to this embodiment.

Figure 4:
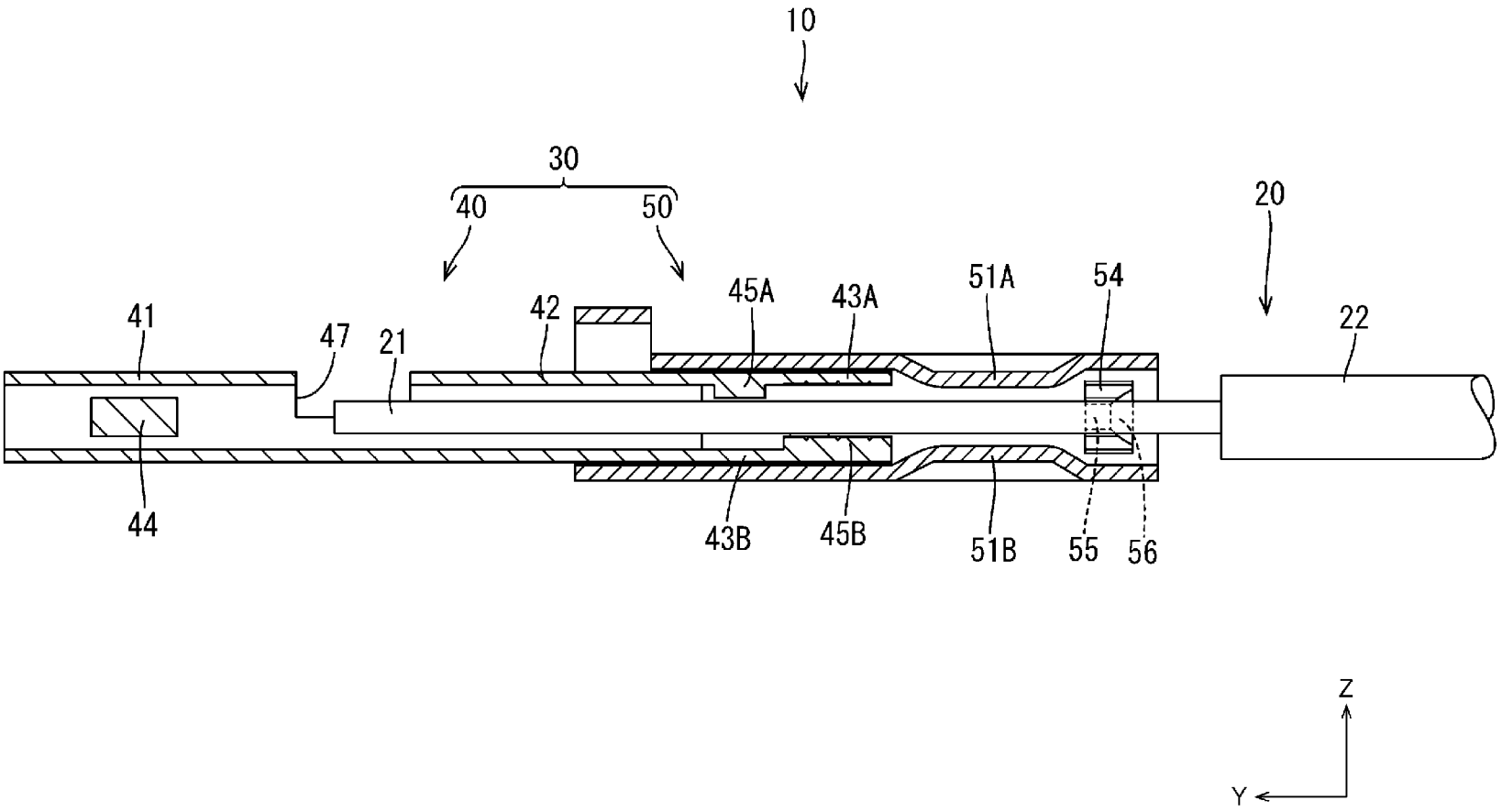
FIG. 4 is a section showing a state before a core of FIG. 3 is sandwiched.

As shown in FIG. 4, the terminal body 40 includes a tube portion 41 and a wire connecting portion 42. A tab of an unillustrated mating terminal is insertable into the tube portion 41. The wire connecting portion 42 is located behind the tube portion 41. The wire connecting portion 42 is connected to the wire 20. The wire connecting portion 42 includes an upper sandwiching portion 43A and a lower sandwiching portion 43B.

The tube portion 41 is in the form of a rectangular tube extending in the front-rear direction. The front end of the tube portion 41 is open so that the tab is insertable. A contact piece 44 is disposed inside the tube portion 41. The contact piece 44 is resiliently deformable. The tab inserted into the tube portion 41 presses and resiliently deforms the contact piece 44. The tab is sandwiched between the inner wall of the tube portion 41 and the contact piece 44 by a resilient force of the resiliently deformed contact piece 44. In this way, the tab and the terminal 30 are electrically connected.

The wire connecting portion 42 in the form of a rectangular tube is provided behind the tube portion 41. The upper sandwiching portion 43A is provided to extend rearward on a rear end part of the ceiling wall (upper wall) of the wire connecting portion 42. The lower sandwiching portion 43B is provided to extend rearward on a rear end part of the bottom wall (lower wall) of the wire connecting portion 42. The upper and lower sandwiching portions 43A, 43B have a shape elongated in the front-rear direction. Lengths in the front-rear direction of the upper and lower sandwiching portions 43A, 43B are equal. "Equal" is not meant in a strict sense, but means that these lengths are in such a range that the effects of the present disclosure are achieved, as long as these can be regarded as equal.

An upper holding protrusion 45A is provided on the lower surface of the upper sandwiching portion 43A. The upper holding protrusion 45A is located in front of a rear end part of the upper sandwiching portion 43A. A lower holding protrusion 45B is provided on the upper surface of the lower sandwiching portion 43B. The lower holding protrusion 45B is disposed on a rear end part of the lower sandwiching portion 43B. The upper and lower holding protrusions 45A, 45B are provided at positions shifted in the front-rear direction.

The lower surface of the upper sandwiching portion 43A and the upper surface of the lower sandwiching portion 43B bite into an oxide film formed on the surface of the core 21 to peel off the oxide film, thereby exposing the metal surface of the core 21. By the contact of this metal surface and the upper and lower sandwiching portions 43A, 43B, the core 21 and the terminal body 40 are electrically connected.

Sliding Portion 50

The sliding portion 50 is in the form of a rectangular tube extending in the front-rear direction. The sliding portion 50 is formed into a predetermined shape by a known method such as cutting, casting or press-working. An arbitrary metal such as copper, copper alloy, aluminum, aluminum alloy or stainless steel can be appropriately selected as a metal constituting the sliding portion 50 if necessary. Although not particularly limited, the sliding portion 50 according to this embodiment is made of stainless steel. A plating layer may be formed on the surface of the sliding portion 50. An arbitrary metal such as tin, nickel or silver can be appropriately selected as a metal constituting the plating layer if necessary.

A cross-sectional shape of the sliding portion 50 is the same as or somewhat larger than that of a region of the terminal body 40 where the upper and lower sandwiching portions 43A, 43B are provided. In this way, the sliding portion 50 is disposed outside the region of the terminal body 40 where the upper and lower sandwiching portions 43A, 43B are provided.

An upper pressurizing portion 51A projecting downward is provided on the lower surface of the ceiling wall (upper wall) of the sliding portion 50. A lower pressurizing portion 51B projecting upward is provided on the upper surface of the bottom wall (lower wall) of the sliding portion 50.

As shown in FIG. 1, partial lock receiving portions 52 and full lock receiving portions 53 are respectively provided on both side walls (left and right walls) of the sliding portion 50. The partial lock receiving portions 52 are disposed at positions near a front end part of the sliding portion 50 and are open laterally. The full lock receiving portions 53 are located behind the partial lock receiving portions 52 and open laterally. The partial lock receiving portions 52 and the full lock receiving portions 53 are resiliently lockable to locking projections 46 provided on both side walls (left and right walls) of the terminal body 40.

With the locking projections 46 of the terminal body 40 and the partial lock receiving portions 52 of the sliding portion 50 locked, the sliding portion 50 is held at a partial locking position (position of the sliding portion 50 in FIG. 4) with respect to the terminal body 40. In this state, the upper and lower pressurizing portions 51A, 51B of the sliding portion 50 are separated rearward from the rear end edges of the upper and lower sandwiching portions 43A, 43B of the terminal body 40. Further, in this state, an interval between the upper and lower sandwiching portions 43A, 43B is set to be larger than a diameter of the core 21.

With the locking projections 46 of the terminal body 40 and the full lock receiving portions 53 of the sliding portion 50 locked, the sliding portion 50 is locked at a full locking position (position of the sliding portion 50 in FIG. 3) with respect to the terminal body 40. In this state, the upper pressurizing portion 51A of the sliding portion 50 is in contact with the upper surface of the upper sandwiching portion 43A from above. Further, the lower pressurizing portion 51B of the sliding portion 50 is in contact with the lower surface of the lower sandwiching portion 43B from below.

As described above, the sliding portion 50 is slidable in the front-rear direction between the partial locking position and the full locking position described above while being externally fit to the region of the terminal body 40 where the upper and lower sandwiching portions 43A, 43B are provided.

With the sliding portion 50 held at the full locking position with respect to the terminal body 40, the upper pressurizing portion 51A presses the upper surface of the upper sandwiching portion 43A from above, whereby the upper sandwiching portion 43A is displaced downward. Further, the lower pressurizing portion 51B presses the lower surface of the lower sandwiching portion 43B from below, whereby the lower sandwiching portion 43B is displaced upward.

In this way, with the core 21 disposed between the upper and lower sandwiching portions 43A and 43B and the sliding portion 50 held at the full locking position with respect to the terminal body 40, the core 21 is sandwiched in the vertical direction by the upper and lower sandwiching portions 43A, 43B. That is, the upper sandwiching portion 43A is pressed downward by the upper pressurizing portion 51A, thereby contacting the core 21 from above, and the lower sandwiching portion 43B is pressed upward by the lower pressurizing portion 51B, thereby contacting the core 21 from below.

With the sliding portion 50 held at the full locking position with respect to the terminal body 40, the upper holding protrusion 45A of the upper sandwiching portion 43A presses the core 21 from above and the lower holding protrusion 45B of the lower sandwiching portion 43B presses the core 21 from below. As a result, the core 21 is pressed from above by the upper holding protrusion 45A and pressed from below by the lower holding protrusion 45B disposed at the position shifted from the upper holding protrusion 45A in the front-rear direction, thereby being held in a state bent in the vertical direction. Therefore, the core 21 and the terminal 30 are electrically connected also by the upper and lower holding protrusions 45A, 45B in addition to the upper and lower sandwiching portions 43A, 43B.

Figure 6:
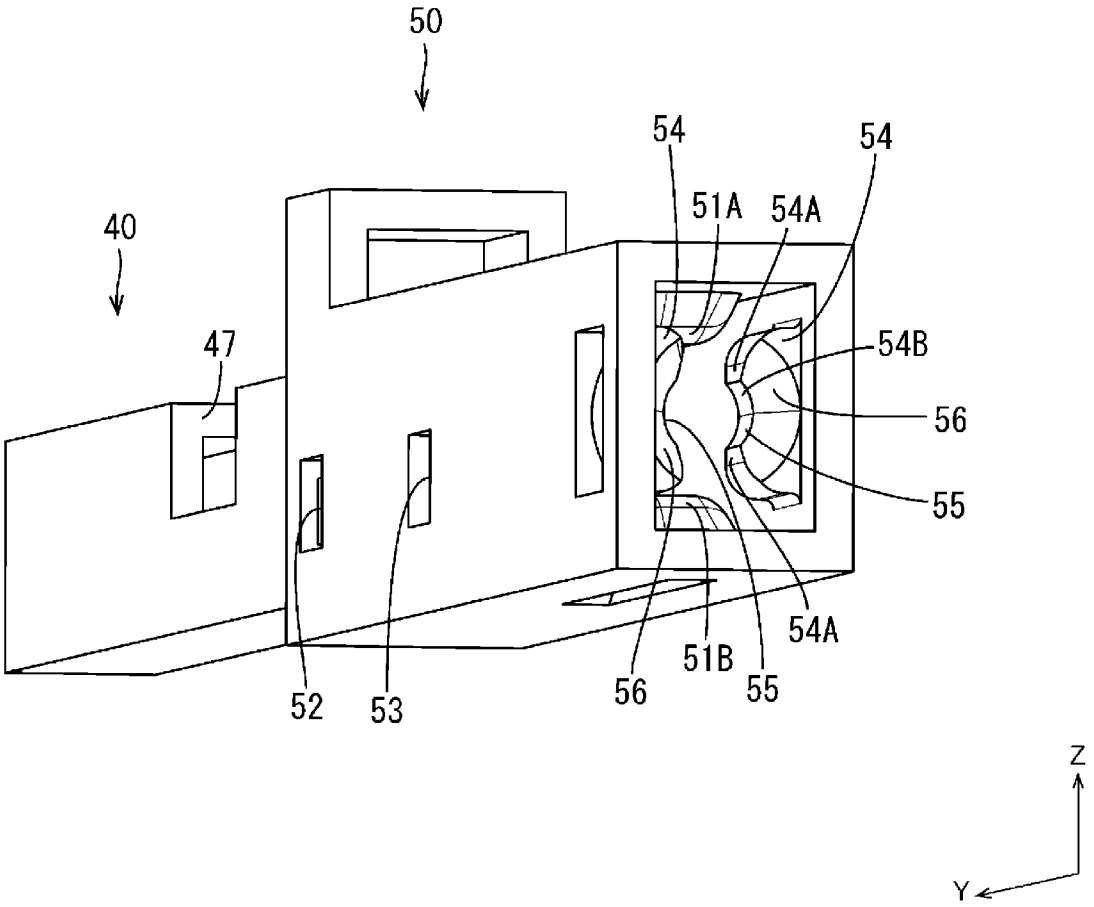
FIG. 6 is a perspective view of a terminal when the sliding portion is viewed obliquely from behind.

As shown in FIG. 6, two restricting ribs 54 are arranged to face each other in the lateral direction at positions near a rear end part of the sliding portion 50. The left restricting rib 54 projects rightward from the left side wall of the sliding portion 50, and the right restricting rib 54 projects leftward from the right side wall of the sliding portion 50. The restricting ribs 54 are formed, for example, by striking parts of the sliding portion 50 by press-working.

Figure 5:
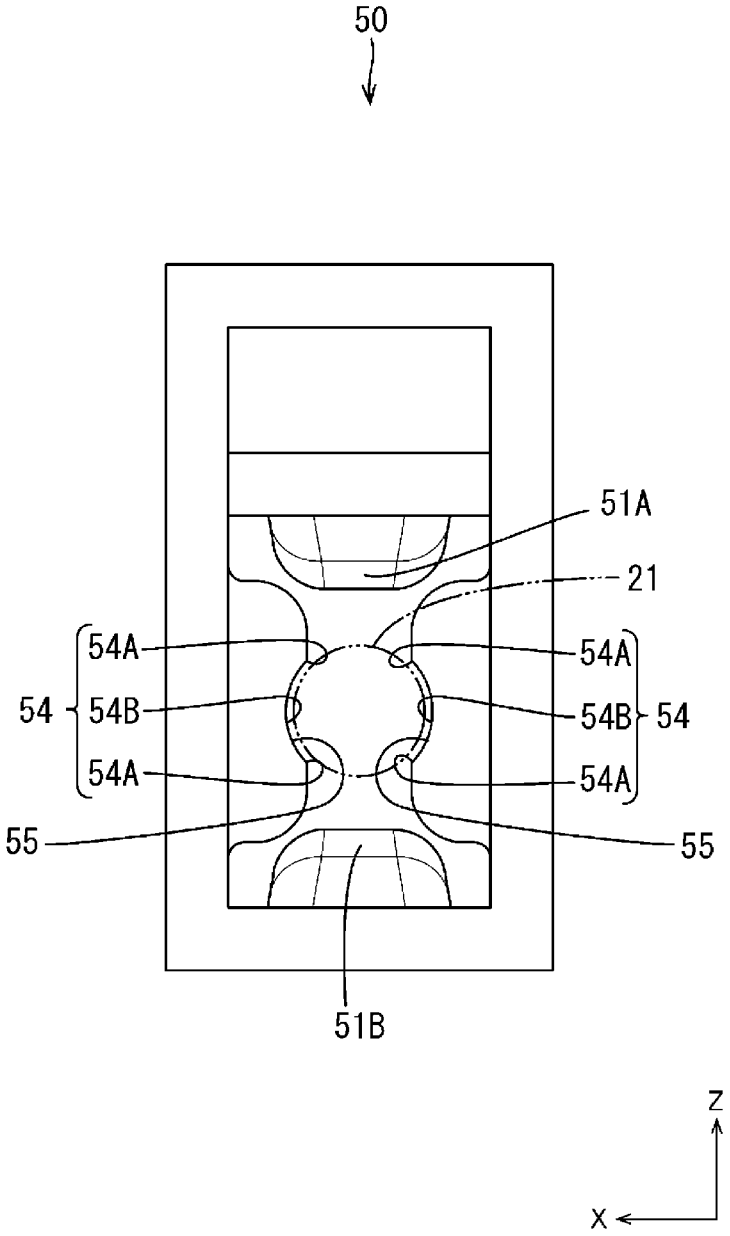
FIG. 5 is a back view of a sliding portion.

The restricting rib 54 includes two first contact portion 54A configured to contact the core 21 in the vertical direction and one second contact portion 54B configured to contact the core 21 in the lateral direction, and the two first contact portions 54A and the one second contact portion 54B are integrally formed. That is, the pair of restricting ribs 54 include at least one pair of first contact portions 54A and at least one pair of second contact portions 54B and are bilaterally symmetrically arranged. When viewed from behind as shown in FIG. 5, the first contact portions 54A are straight parts extending in the vertical direction and the second contact portions 54B are curved parts concave toward the side walls of the sliding portion 50 from the first contact portions 54A.

Surfaces of the pair of first contact portions 54A facing each other are arranged in parallel. A dimension between the facing surfaces of the pair of first contact portions 54A is smaller than the diameter of the core 21. Accordingly, if the core 21 is going to move upward, an upward movement of the core 21 is restricted by the contact of the core 21 with lower end parts of the upper first contact portions 54A. Further, if the core 21 is going to move downward, a downward movement of the core 21 is restricted by the contact of the core 21 with upper end parts of the lower first contact portions 54A.

The first contact portions 54A are arranged to be continuous with both upper and lower sides of the second contact portion 54B. An arcuate inserting portion 55 is formed by the second contact portion 54B and the pair of first contact portions 54A. As shown in FIG. 5, a pair of the inserting portions 55 are disposed on both left and right sides of the core 21 and shaped to extend along the outer periphery of the core 21. A maximum dimension between facing surfaces of the pair of second contact portions 54B is slightly larger than the diameter of the core 21. If the core 21 is going to move leftward, a movement is restricted by the contact of the core 21 with the left second contact portion 54B. Further, if the core 21 is going to move rightward, a movement is restricted by the contact of the core 21 with the right second contact portion 54B.

A pair of guiding portions 56 are provided behind the pair of inserting portions 55. The front edges of the pair of guiding portions 56 are connected to the rear edges of the pair of inserting portions 55. The guiding portion 56 has an inclined surface enlarged in diameter from the rear edge of the inserting portion 55 toward a rear side. In other words, the inclined surface of the guiding portion 56 is inclined in a mortar shape to extend toward the rear edge of the inserting portion 55. Thus, the core 21 having contacted the guiding portions 56 is guided into between the pair of inserting portions 55 when moving forward.

Connection Method of Wire 20 and Terminal 30

The core 21 of the wire 20 is exposed by stripping the insulation coating 22 by a known method. The wire 20 is inserted with the sliding portion 50 held at the partial locking position. When the wire 20 is inserted toward the sliding portion 50 from behind, the tip of the core 21 is guided into between the pair of inserting portions 55 while contacting the guiding portions 56.

When being inserted between the pair of inserting portions 55, the core 21 contacts the first contact portions 54A of the inserting portions 55, whereby a movement in the vertical direction is restricted, and contacts the second contact portion 54B of the inserting portion 55, whereby a movement in the lateral direction is restricted. Further, if the core 21 is curled, the core 21 is straightened by the respective contact portions 54A, 54B when passing through the inserting portions 55. In this way, the core 21 having passed through the inserting portions 55 is inserted straight.

The core 21 extends between a rear half of the upper sandwiching portion 43A and the lower holding protrusion 45B without interfering with the rear end of the upper sandwiching portion 43A and the rear end of the lower holding protrusion 45B after passing between the upper and lower pressurizing portions 51A, 51B. The core 21 extends between the upper holding protrusion 45A and a front half of the lower sandwiching portion 43B without interfering with the rear end of the upper holding protrusion 45A after passing between the rear half of the upper sandwiching portion 43A and the lower holding protrusion 45B. The core 21 enters the terminal body 40 to reach a state of FIG. 4 without interfering with the rear end of the terminal body 40 after passing between the upper holding protrusion 45A and the front half of the lower sandwiching portion 43B.

Figure 2:
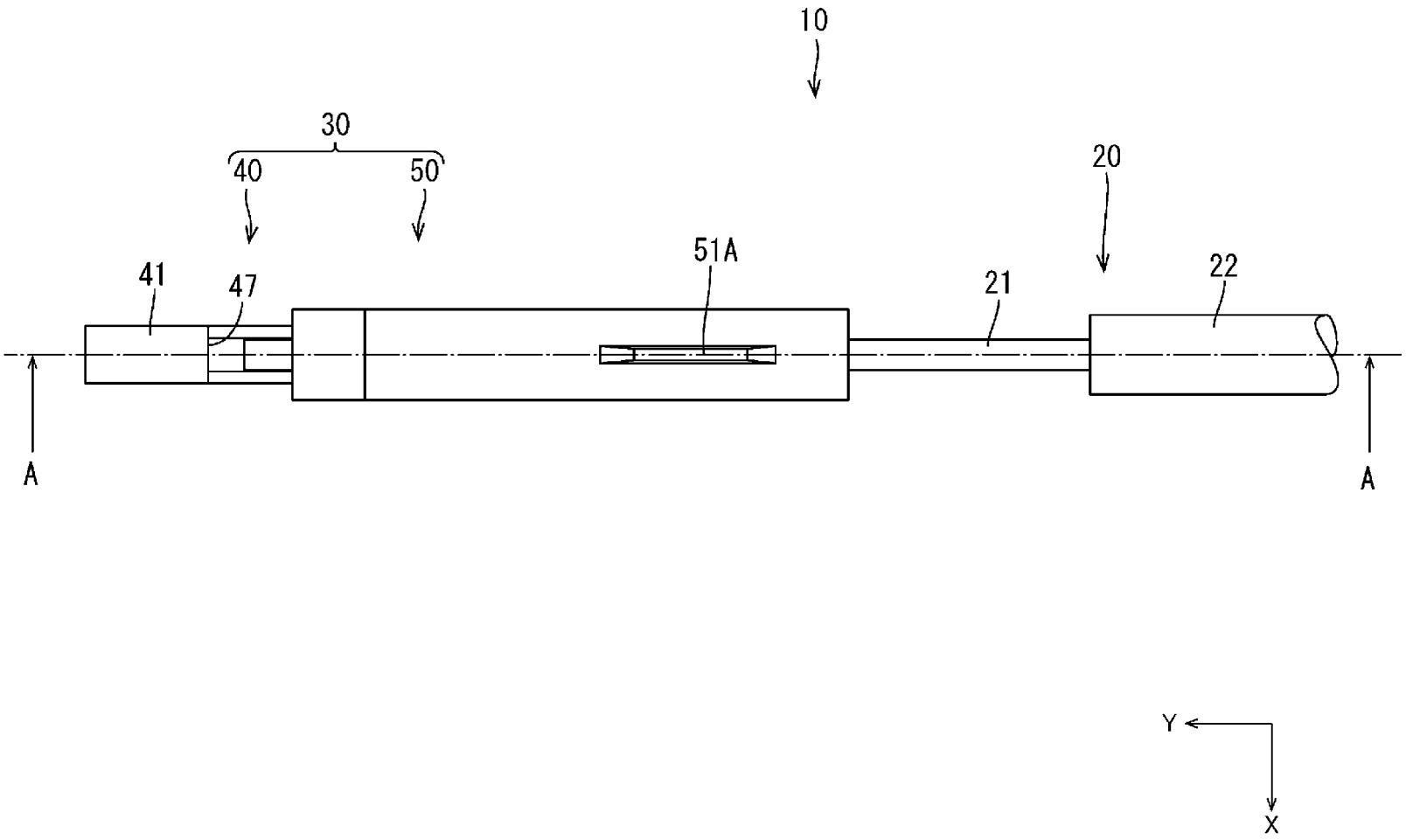
FIG. 2 is a plan view of the wire with terminal.
Figure 3:
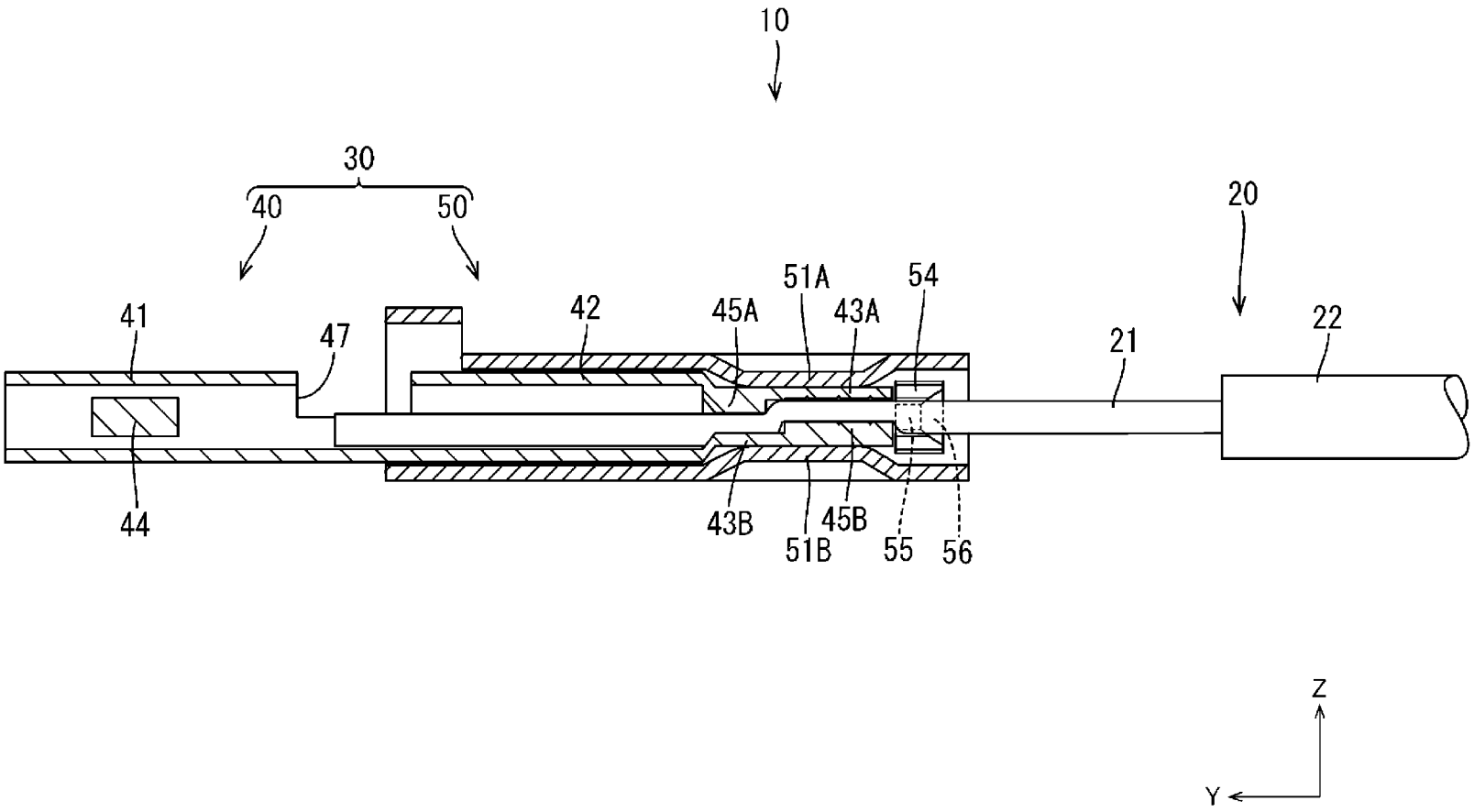
FIG. 3 is a section along A-A of FIG. 2.

The tip of the core 21 is located between the rear end of the tube portion 41 and the front end of the wire connecting portion 42. An opening 47 open upward is provided between the rear end of the tube portion 41 and the front end of the wire connecting portion 42. As shown in FIG. 2, the tip of the core 21 can be visually confirmed from above, whereby it can be confirmed that the core 21 could be inserted without any problem without being interfered during insertion.

When the sliding portion 50 is subsequently pushed forward toward the full locking position from the partial locking position, locking between the locking projections 46 of the terminal body 40 and the partial lock receiving portions 52 of the sliding portion 50 is released to allow a sliding movement of the sliding portion 50. With the start of the sliding movement, the side walls of the sliding portion 50 ride on the locking projections 46 to be expanded and deformed.

During the sliding movement, the upper pressurizing portion 51A of the sliding portion 50 comes into contact with the upper sandwiching portion 43A of the terminal body 40 from above to press the upper sandwiching portion 43A downward and the lower pressurizing portion 51B of the sliding portion 50 comes into contact with the lower sandwiching portion 43B from below to press the lower sandwiching portion 43B upward. In this way, the core 21 is sandwiched in the vertical direction by the upper and lower sandwiching portions 43A, 43B.

By sandwiching the core 21 in the vertical direction by the upper and lower sandwiching portions 43A, 43B, the oxide film formed on the surface of the core 21 is peeled off to expose the metal constituting the core 21. By the contact of this metal and the upper and lower sandwiching portions 43A, 43B, the core 21 of the wire 20 and the terminal 30 are electrically connected.

When the sliding portion 50 reaches the full locking position, the side walls of the sliding portion 50 are resiliently restored and the locking projections 46 of the terminal body 40 and the full lock receiving portions 53 of the sliding portion 50 are locked. In this way, the sliding portion 50 is held at the full locking position.

With the core 21 sandwiched in the vertical direction by the upper and lower sandwiching portions 43A, 43B, the core 21 is sandwiched at positions shifted in the front-rear direction by the upper holding protrusion 45A of the upper sandwiching portion 43A and the lower holding protrusion 45B of the lower sandwiching portion 43B, thereby being held in a state extending in the front-rear direction and bent in the vertical direction. Since the core 21 can be firmly held in this way, the wire 20 is not detached from the terminal 30 when a pulling force acts on the wire 20. In this way, a holding force of the wire 20 and the terminal 30 can be enhanced.

Second Embodiment

A second embodiment of the present disclosure is described with reference to FIGS. 7 to 9. The second embodiment is configured by partially changing the configuration of the sliding portion 50 of the first embodiment and other components are the same as in the first embodiment and, hence, not described. Further, the same components as those of the first embodiment are denoted by the same reference signs as in the first embodiment.

Figure 7:
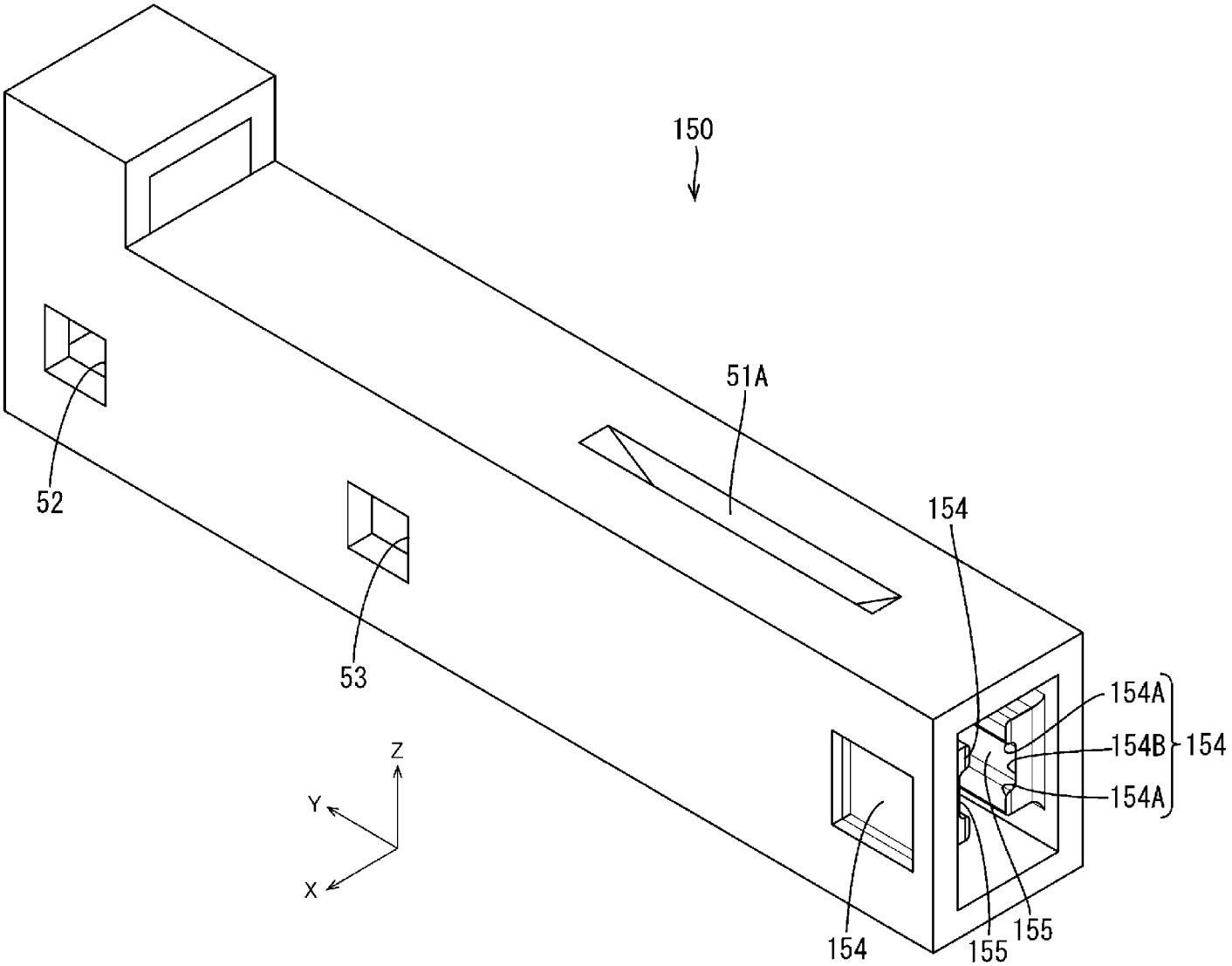
FIG. 7 is a perspective view of a sliding portion in a second embodiment.

As shown in FIG. 7, a sliding portion 150 of this embodiment includes two restricting ribs 154. As shown in FIG. 9, the two restricting ribs 154 are provided at positions near a rear end part of the sliding portion 150 and behind two pressurizing portions 51A, 51B. The two restricting ribs 154 are provided at positions facing each other in the lateral direction. The left restricting rib 154 projects rightward from the left side wall of the sliding portion 150, and the right restricting rib 154 projects leftward from the right side wall of the sliding portion 150. The restricting ribs 154 are formed, for example, by striking parts of the sliding portion 150 by press-working.

Figure 8:
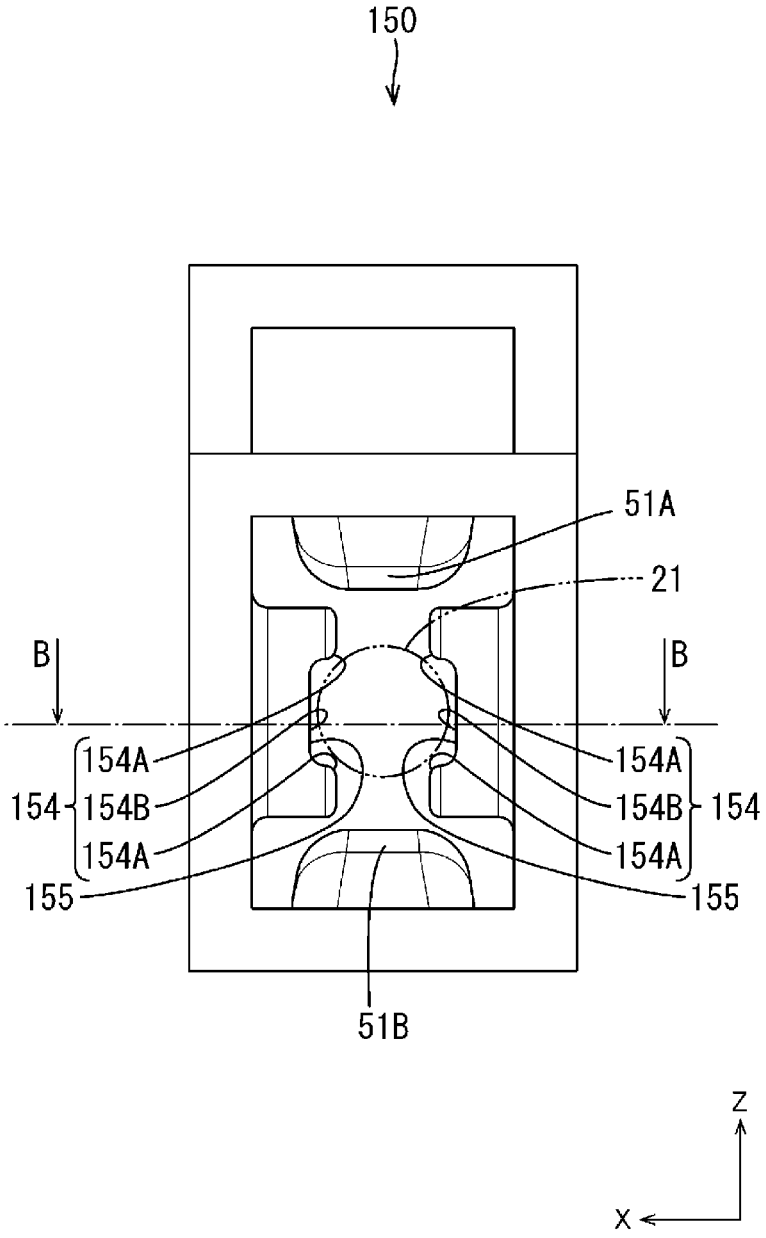
FIG. 8 is a back view of the sliding portion.
Figure 9:
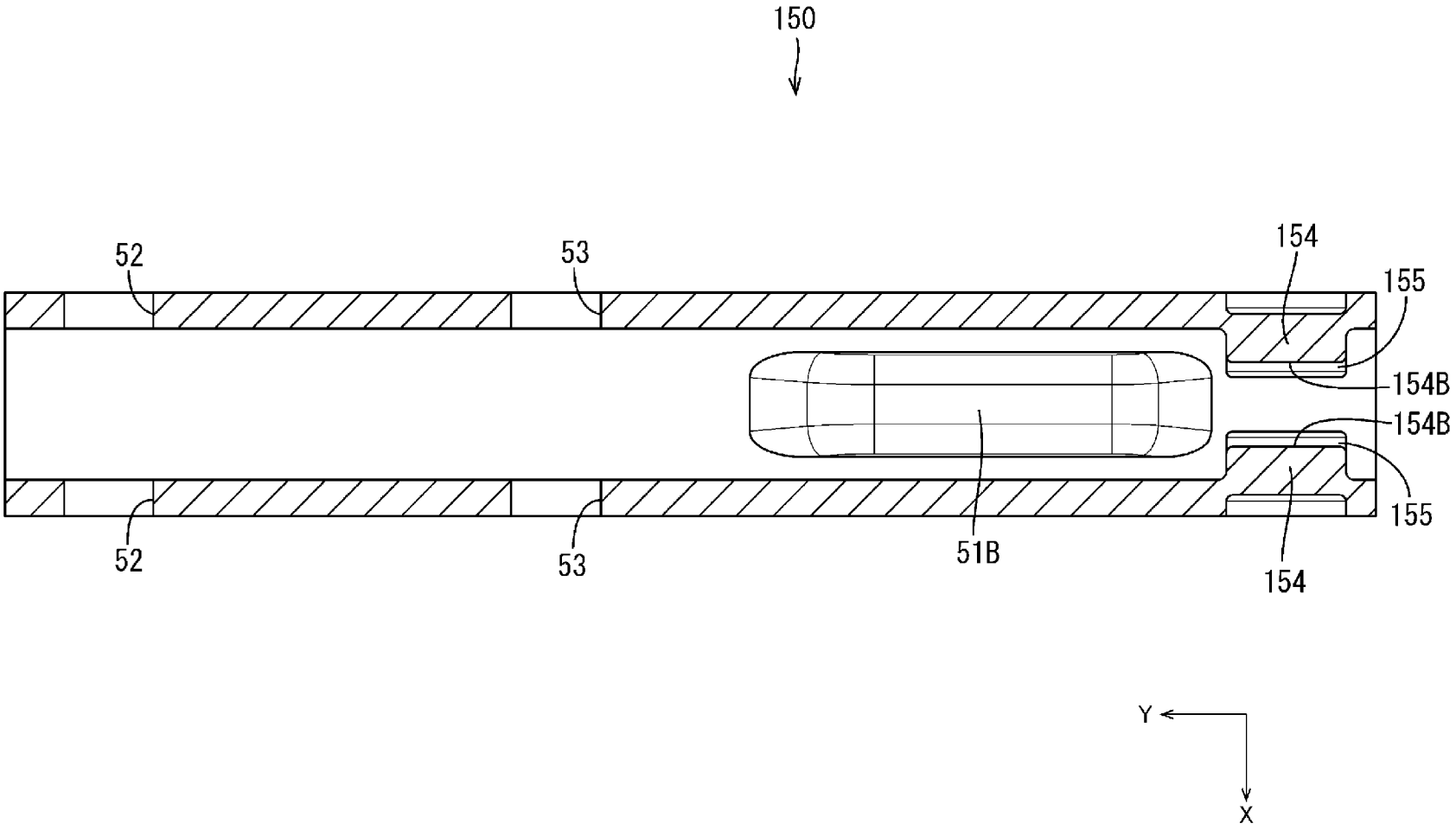
FIG. 9 is a section along B-B of FIG. 8.

As shown in FIG. 8, the restricting rib 154 includes two first contact portion 154A configured to contact a core 21 in the vertical direction and one second contact portion 154B configured to contact the core 21 in the lateral direction, and the two first contact portions 154A and the one second contact portion 154B are integrally formed. That is, the pair of restricting ribs 154 include at least one pair of first contact portions 154A and at least one pair of second contact portions 154B and are bilaterally symmetrically arranged. When viewed from behind, the first contact portions 154A are straight parts extending in the vertical direction and the second contact portions 154B are straight parts offset toward the side walls of the sliding portion 150 from the first contact portions 154A.

Surfaces of the pair of first contact portions 154A facing each other are arranged in parallel. A dimension between the facing surfaces of the pair of first contact portions 154A is smaller than a diameter of the core 21. Accordingly, if the core 21 is going to move upward, an upward movement of the core 21 is restricted by the contact of the core 21 with lower end parts of the upper first contact portion 154A. Further, if the core 21 is going to move downward, a downward movement of the core 21 is restricted by the contact of the core 21 with upper end parts of the lower first contact portion 154A.

The first contact portions 154A are arranged to be continuous with both upper and lower sides of the second contact portion 154B. A gate-shaped inserting portion 155 is formed by the second contact portion 154B and the pair of first contact portions 154A. As shown in FIG. 8, a pair of the inserting portions 155 are disposed on both left and right sides of the core 21 and shaped to extend in tangential directions on both left and right ends of the outer peripheral surface of the core 21. The facing surfaces of the pair of second contact portions 154B are arranged in parallel. A dimension between the facing surfaces of the pair of second contact portions 154B is slightly larger than the diameter of the core 21. If the core 21 is going to move leftward, a movement is restricted by the contact of the core 21 with the left second contact portion 154B. Further, if the core 21 is going to move rightward, a movement is restricted by the contact of the core 21 with the right second contact portion 154B. The rear end of the restricting rib 154 of the present disclosure is formed into a flat surface. However, without limitation to such a shape, the rear end of a restricting rib may be formed into a tapered shape capable of guiding the tip of the core 21 to the inserting portion 155.

Third Embodiment

A third embodiment of the present disclosure is described with reference to FIGS. 10 to 12. The third embodiment is configured by partially changing the configuration of the sliding portion 50 of the first embodiment and other components are the same as in the first embodiment and, hence, not described. Further, the same components as those of the first embodiment are denoted by the same reference signs as in the first embodiment.

Figure 10:
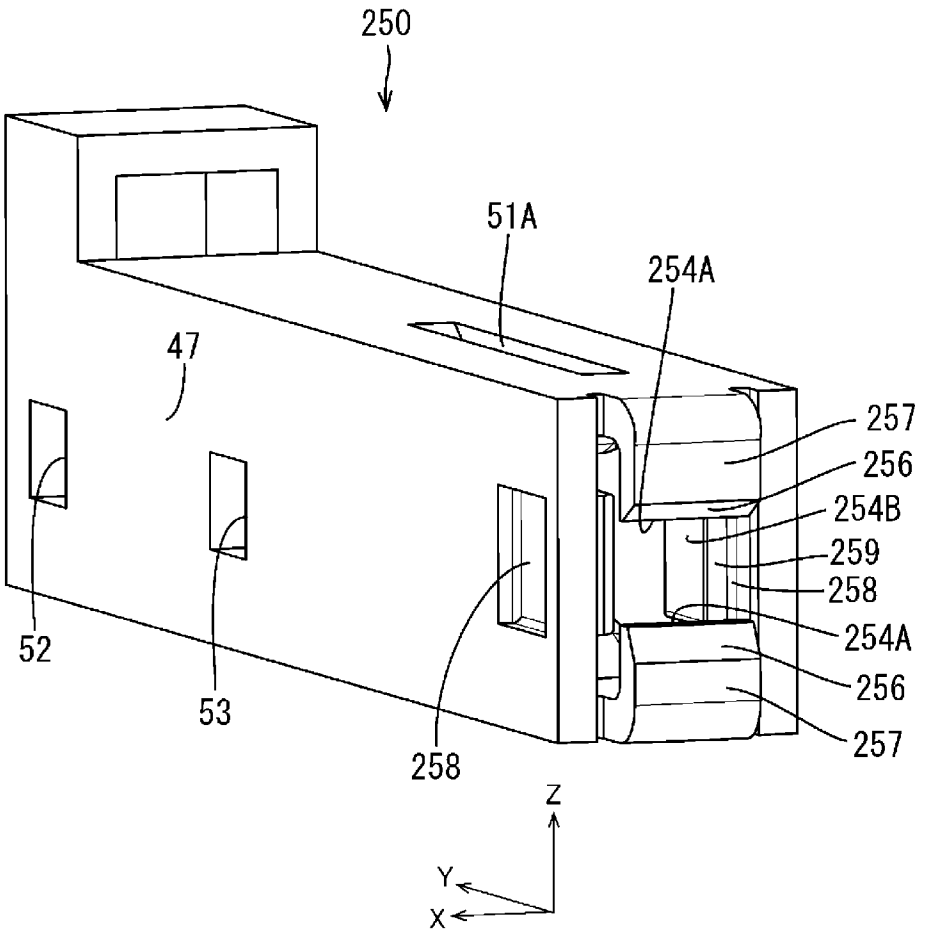
FIG. 10 is a perspective view of a sliding portion in a third embodiment.
Figure 11:
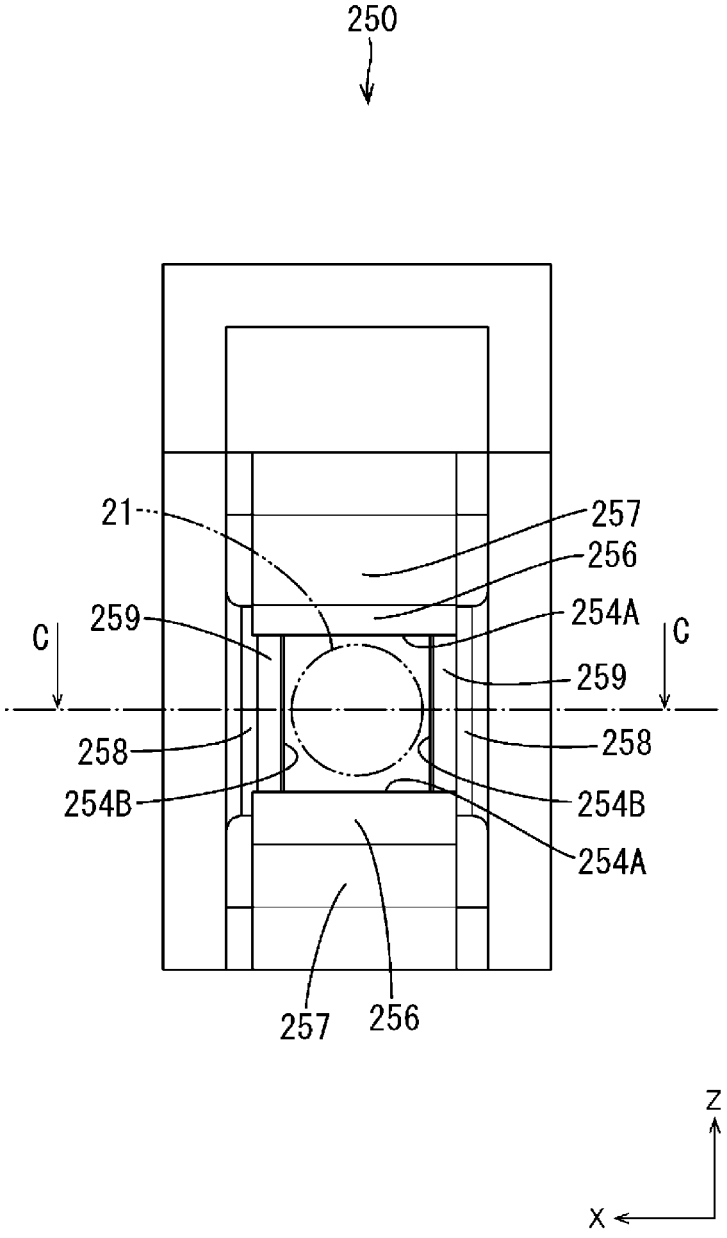
FIG. 11 is a back view of the sliding portion.

As shown in FIG. 10, a sliding portion 250 of this embodiment includes two bent pieces 257 and two projections 258.

The two bent pieces 257 include the upper bent piece 257 provided on the rear edge of the ceiling wall of the sliding portion 250 and the lower bent piece 257 provided on the rear edge of the bottom wall. The upper bent piece 257 is cantilevered and bent at a right angle to extend downward after extending rearward from the rear edge of the ceiling wall. The lower bent piece 257 is cantilevered and bent at a right angle to extend upward after extending rearward from the rear edge of the bottom wall.

A lower end part of the upper bent piece 257 serves as an upper first contact portion 254A and an upper end part of the lower bent piece 257 serves as a lower first contact portion 254A. The two first contact portions 254A are arranged to face each other in the vertical direction. An upper guiding portion 256 extending more upward toward a rear side is provided on the rear edge of the upper first contact portion 254A. A lower guiding portion 256 extending more downward toward the rear side is provided on the rear edge of the lower first contact portion 254A.

Figure 12:
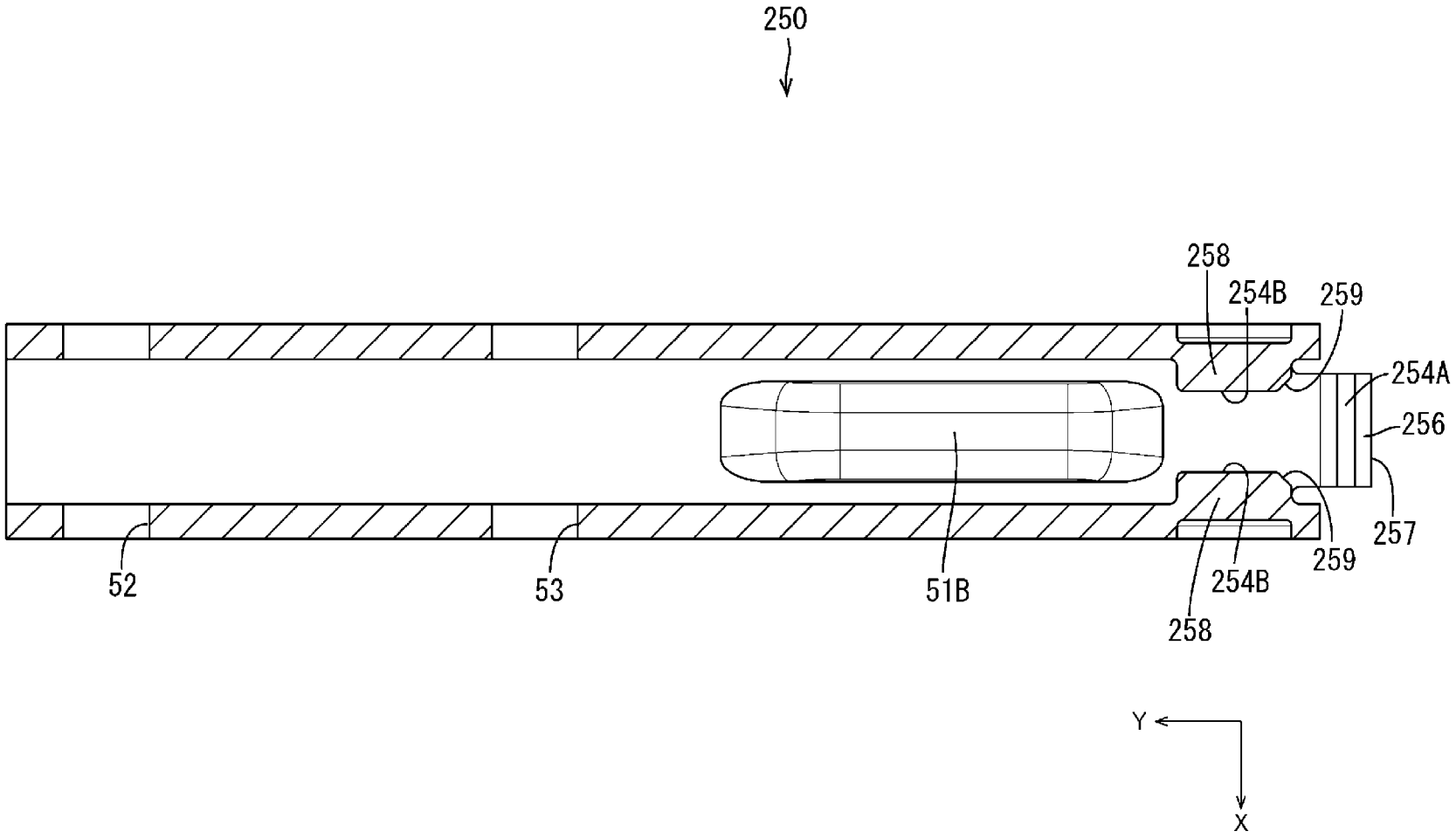
FIG. 12 is a section along C-C of FIG. 11.

As shown in FIG. 12, the two projections 258 are arranged to face each other in the lateral direction. The left projection 258 projects rightward from the left side wall of the sliding portion 250, and the right projection 258 projects leftward from the right side wall of the sliding portion 250. The projections 258 are formed, for example, by striking parts of the sliding portion 250 by press-working. The projecting end surface of the projection 258 serves as a second contact portion 254B. A right guiding portion 259 extending more rightward toward the rear side is provided on the rear edge of the right projection 258. A left guiding portion 259 extending more leftward toward the rear side is provided on the rear edge of the left projection 258.

When a wire 20 is inserted into the sliding portion 250 from behind, the tip of the core 21 is guided into between the pair of first contact portions 254A while contacting the guiding portions 256. A movement of the core 21 in the vertical direction is restricted by the contact of the core 21 with the pair of first contact portions 254A. Thereafter, the tip of the core 21 is guided into between the pair of second contact portions 254B while contacting the guiding portions 259. A movement of the core 21 in the lateral direction is restricted by the contact of the core 21 with the pair of second contact portions 254B.

Since the first and second contact portions 254A, 254B are separately provided in this embodiment, more accurate processing is possible, which is advantageous in terms of manufacturing, than in the case of integrally providing the contact portions 254A, 254B. Further, since both the bent pieces 257 of the first contact portions 254A and the projections 258 of the second contact portions 254B are simple in shape, dimension accuracy is enhanced, which is also advantageous in terms of manufacturing.

Other Embodiments (1) Although the pair of left and right restricting ribs 54, 154 are provided in the first and second embodiments, only either one of them may be provided. For example, if only the right restricting rib 54, 154 is provided, the left side wall facing the right restricting rib 54, 154 functions as a second contact portion.

(2) Although the restricting rib 54, 154 are provided with the pair of first contact portions 54, 154 in the first and second embodiments, only either one of them may be provided. For example, the ceiling wall facing the lower first contact portion 54A, 154A functions as a first contact portion.

(3) Although the pair of upper and lower bent pieces 257 are provided in the third embodiment, only either one of them may be provided. Similarly, although the pair of left and right projections 258 are provided, only either one of them may be provided.

(4) Although the first contact portions 54A, 154A and the second contact portion 54B, 154B are integrally provided in the first and second embodiments, a first contact portion and a second contact portion may be separately provided. For example, a first contact portion may be provided on the ceiling wall or bottom wall and a second contact portion may be provided on the side wall.

(5) Although no guiding portions are provided in the second embodiment, guiding portions may be provided by forming rear end parts of restricting ribs into a tapered shape.

(6) Although the arcuate inserting portions 55 are illustrated in the first embodiment, inserting portions may have a curved surface shape other than the arcuate shape.

(7) Although the core 21 is sandwiched by the two sandwiching portions 43A, 43B in the first and second embodiments, a core may be sandwiched by one sandwiching portion and a wall part facing this sandwiching portion. Further, a core may be sandwiched by three or more sandwiching portions.

LIST OF REFERENCE NUMERALS

10 . . . wire with terminal
20 . . . wire
21 . . . core
22 . . . insulation coating
30 . . . terminal
40 . . . terminal body
41 . . . tube portion
42 . . . wire connecting portion
43A . . . upper sandwiching portion
43B . . . lower sandwiching portion
44 . . . contact piece
45A . . . upper holding protrusion
45B . . . lower holding protrusion
46 . . . locking projection
47 . . . opening
50, 150, 250 . . . sliding portion
51A . . . upper pressurizing portion
51B . . . lower pressurizing portion
52 . . . partial lock receiving portion
53 . . . full lock receiving portion
54, 154 . . . restricting rib
54A, 154A, 254A . . . first contact portion
54B, 154B, 254B . . . second contact portion
55 . . . inserting portion
56, 256, 259 . . . guiding portion
257 . . . bent piece
258 . . . projection

What is claimed is:

1. A terminal to be connected to a wire including a core, comprising:
a terminal body; and
a sliding portion,
wherein:
the terminal body includes a sandwiching portion configured to sandwich the core of the wire,
sliding portion is slidable in a front-rear direction between a partial locking position and a full locking position while being externally fit to a region where the sandwiching portion is provided, and the core is inserted into the sliding portion from behind, and
the sliding portion includes a pressurizing portion configured to press the sandwiching portion at the full locking position to sandwich the core in a first direction by the sandwiching portion, at least a pair of first contact portions provided behind the pressurizing portion and configured to contact the core in the first direction when the core is inserted into the sliding portion, and at least a pair of second contact portions provided behind the pressurizing portion and configured to contact the core in a second direction intersecting the first direction when the core is inserted into the sliding portion.

2. The terminal of claim 1, wherein an inserting portion into which the core is inserted is shaped to include the second contact portion and a pair of the first contact portions projecting further toward the core than the second contact portion from both sides of the second contact portion.

3. The terminal of claim 2, wherein the inserting portion is formed into an arched shape by the second contact portion and the pair of first contact portions connected to the second contact portion, and a pair of the inserting portions are disposed on both sides of the core.

4. The terminal of claim 2, wherein the sliding portion includes a pair of guiding portions enlarged in diameter from rear edges of a pair of the inserting portions toward a rear side.

5. The terminal of claim 1, wherein the pair of the first contact portions are provided to project in the first direction from a pair of walls facing each other in the first direction, out of a peripheral wall of the sliding portion, and the pair of second contact portions are provided to project in the second direction from a pair of walls facing each other in the second direction, out of the peripheral wall of the sliding portion.

6. A wire with terminal, comprising:
the terminal of claim 1; and
the wire.

* * * * *